United States Patent [19]

Youmans et al.

[11] 4,031,750

[45] June 28, 1977

[54] APPARATUS FOR LOGGING INCLINED EARTH BOREHOLES

[75] Inventors: Arthur H. Youmans; Heinz D. Lichtenberg, both of Houston, Tex.

[73] Assignee: Dresser Industries, Inc., Dallas, Tex.

[22] Filed: Sept. 2, 1976

[21] Appl. No.: 719,749

[52] U.S. Cl. ..... 73/151

[51] Int. Cl.[2] ..... E21B 47/00

[58] Field of Search ..... 73/151, 152; 181/102; 324/10

[56] References Cited

UNITED STATES PATENTS

| | | | |
|---|---|---|---|
| 2,776,564 | 1/1957 | Montgomery et al. | 73/151 |
| 3,670,566 | 6/1972 | Basham et al. | 73/151 |

*Primary Examiner*—Jerry W. Myracle

*Attorney, Agent, or Firm*—William E. Johnson, Jr.

[57] ABSTRACT

An elongated borehole logging instrument includes a permanent magnet linear reciprocating motor. The motor powers a sliding sleeve which has attached to its outer perimeter a series of reversible vanes. The vanes engage the mud cake or the borehole wall and thus generate a force opposite to the direction of the vane slant. The motor has a stationary electromagnetic field comprised of a plurality of coils connected to the control electronics. The floating outer sleeve has permanent magnets all oriented in the same direction. As the coils are pulsed alternatingly, the magnets are either repulsed or attracted to thus generate a reciprocating motion which transferred to the vanes moves the tool up or down, depending upon the position of the reversing actuator.

7 Claims, 5 Drawing Figures

APPARATUS FOR LOGGING INCLINED EARTH BOREHOLES

BACKGROUND OF THE INVENTION

This invention relates generally to apparatus for logging earth boreholes and specifically to methods and apparatus which utilize means in addition to gravity to cause the well logging instruments to traverse the high angled earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes may even extend past 90° from the vertical and actually be extending in the up direction for some distance.

It is also well known in the art of drilling such wells to attempt the logging of the formations surrounding such boreholes with logging instruments run into the well bore on a wireline and/or a cable to perform various operations. Such tools usually depend upon the force of gravity to permit positioning of the well tool at the desired formation in the well bore.

Manifestly, the relatively horizontal angle of the deviated portion of the well bore will not permit the wireline actuated tools to move into the lower portion of the well bore since friction of the well tool in the deviated portion works against the force of gravity. Thus it has become essential to provide some means of causing the well logging instrument to pass through the deviated portions of the well bore.

Another problem associated with such boreholes relates to the instability of some formations penetrated by the well bore, thus causing borehole diameter changes, some very abrupt. Ledges are formed, and the logging instrument lodges against them.

It is therefore the primary object of the present invention to provide a new and improved apparatus for logging earth boreholes;

It is also an object of the present invention to provide apparatus for logging deviated boreholes in which it is difficult for the well logging instrument to traverse the borehole simply with the aid of gravity.

The objects of the invention are accomplished, generally, by apparatus having means to generate an additional force which causes the instrument to move along the inclined portion of the earth borehole by utilizing a plurality of vanes which contact the face of the borehole and impart a force in a direction opposite from the slant of the vanes.

These and other objects, features and advantages of the present invention will be apparent from the following detailed description taken with reference to the figures of the accompanying drawings, wherein.

Figure 1:
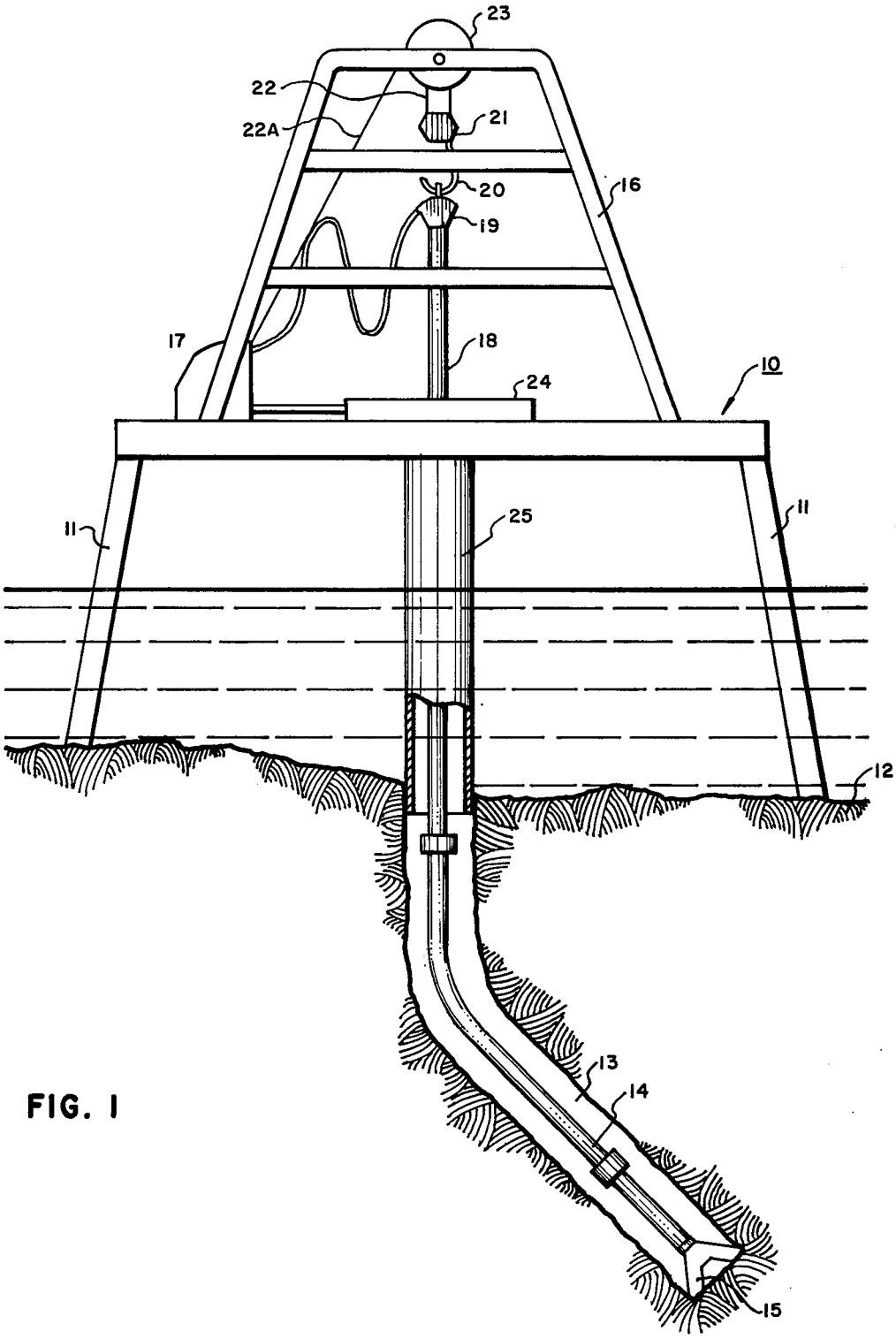
FIG. 1 is a schematic view illustrating the drilling of a deviated earth borehole from an offshore platform.

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks also drive a rotary table 24 which in turn transmits the drive to the kelly 18. One end of the line 22, namely the fast line **22*a*, is connected to the drawworks 17** which contains the motor or motors for manipulating the drill string. Although not illustrated, the other end of the drill line is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
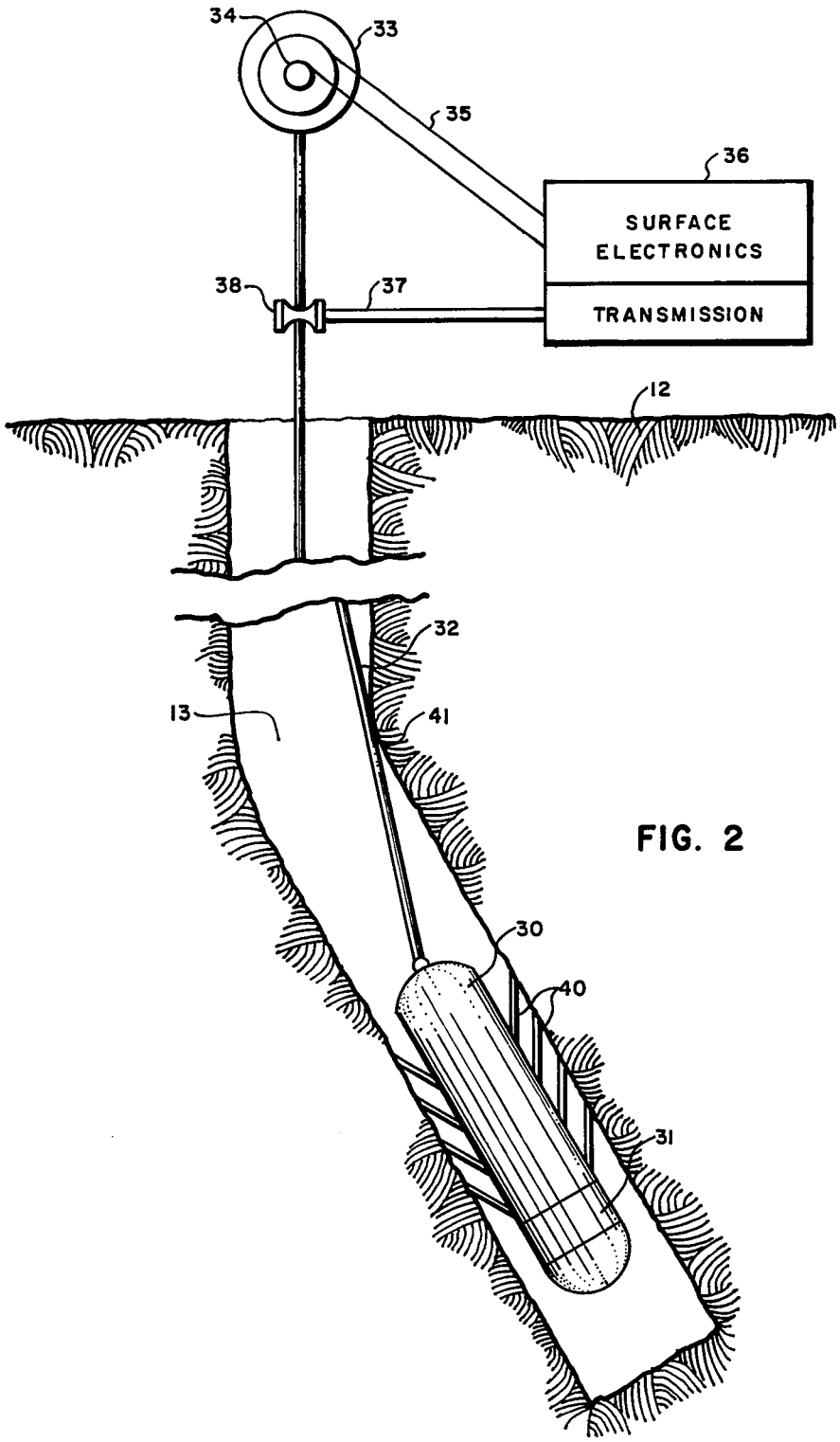
FIG. 2 is a schematic view illustrating the well logging instrument constructed in accordance with the present invention traversing a highly deviated earth borehole.

Referring now to FIG. 2, there is illustrated schematically a well logging operation in which a portion of the earth's surface 12 is shown in vertical section. A well 13 which has been drilled as illustrated in FIG. 1 penetrates the earth's surface. Disposed within the well is subsurface instrument 30 of the well logging system. Subsurface instrument 30 includes a logging module 31 which may be of any conventional type. For example, it may be a neutron source and detector as used in a radioactivity log or it might be an induction, electric, acoustic or any other of the conventional logs well known in the art. It should be appreciated that the particular type of well logging module forms no part of the present invention. Cable 32 suspends the instrument 30 in the well and contains the required conductors for electrically connecting the instrument 30 with the surface apparatus. The cable is wound on or unwound from drum 33 in raising and lowering the instrument 30 to traverse the well. During the traversal, the signals from the well logging module 31 are sent up the cable 32. Through slip rings and brushes 34 on the end of the drum 33, the signals are conducted by the lines 35 to the surface electronics 36. A recorder (not illustrated) within the surface electronics 36 is driven through the transmission 37 by the measuring reel 38, over which the cable 32 is drawn, so that the recorder within the surface electronics moves in correlation with depth as instrument 30 traverses the well. It is also to be understood that the instrument 30 is constructed to withstand the pressures and mechanical and thermal abuses encountered in logging a deep well.

As illustrated in FIG. 2, the instrument 30 has a plurality of flexible vanes 40 which are slanted in the upward direction and which, as will be explained in more detail hereinafter, help the instrument 30 to be lowered into the highly deviated borehole.

It should be noted that the cable 32 is resting against a ledge 41 which also hinders the tool 30 from being lowered into the earth borehole simply by the force of gravity.

Figure 3:
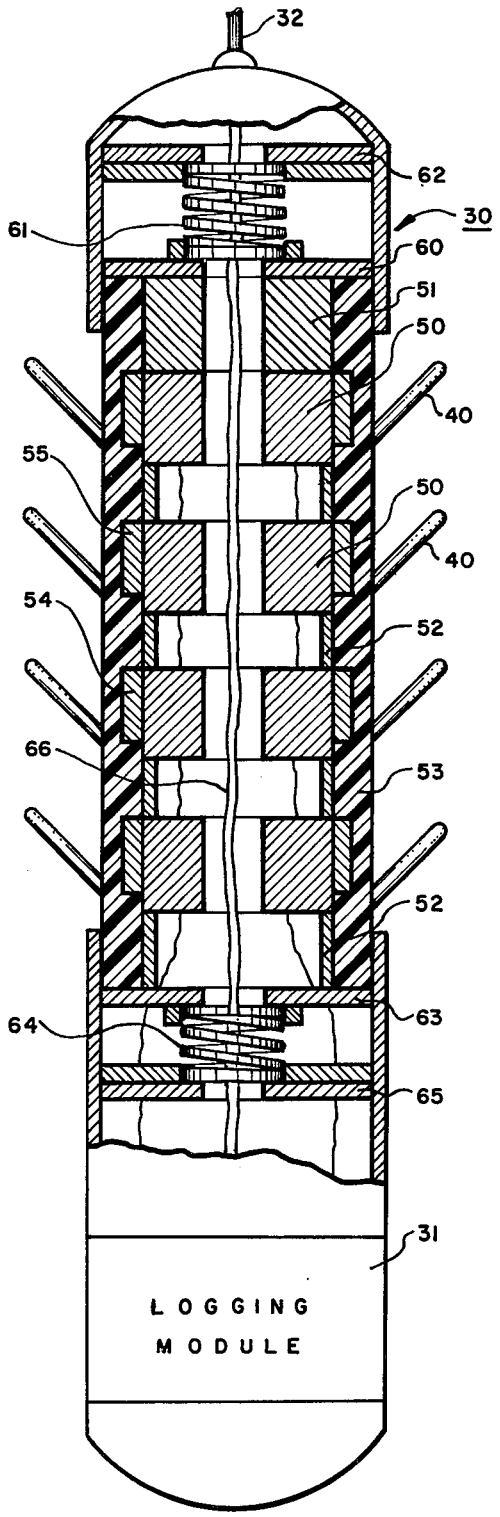
FIG. 3 is an enlarged schematic view, partly in cross section, illustrating the well logging instrument in accordance with the present invention.

Referring now to FIG. 3, the instrument 30 is illustrated in greater detail. The instrument 30 has a plurality of pulsed electromagnets 50 which are fixedly attached to the support mandrel of the instrument housing 30 by the spacer element 51, and by a similar such element 52 between each of the electromagnets. A floating sleeve 53 constructed, for example, from a hard plastic material or some other such material which will not substantially affect the magnetic characteristics of the electromagnets and the permanent ring magnets 54 which are embedded therein, is adapted to slide up and down around the mandrel containing the electromagnets.

The spacer 51 is attached to an end plate 60 which in turn is attached to a spring 61 acting against an additional end plate 62.

In a similar manner, the spacer 52 at the lower end of the mandrel is attached to an end plate 63 against which a spring 64 rides which is attached to an additional end plate 65. Passing through the center of the various end plates and the electromagnets is an electrical cable 66 which is connected to the cable 32 and also to the logging module 31. Electrical conductors are also connected between the various electromagnets and the control electronics incorporated within the logging module 31 for pulsing the electromagnets. This, of course, can be done from the earth's surface or in response to some predetermined occurrence to cause the electromagnets to be pulsed.

In the operation of the apparatus according to FIG. 3, it should be appreciated that the assembly comprises, effectively, a linear reciprocating motor. The motor powers a sleeve 53 to which the vanes 40 are attached and having a particular slant, in this case slanted in a direction uphole. The permanent ring magnets are all oriented in the same direction. As the coils are pulsed alternatively, the magnets are either repulsed or attracted which thus generates a reciprocating motion which, transferred to the vanes 40, moves the tool up or down, depending upon the position of the reversing actuator discussed hereinafter with respect to FIGS. 4 and 5.

It should be appreciated that the sleeve 53 is effectively floating around the electromagnets because of the springs 61 and 64 at opposite ends of the assembly. However, the invention also contemplates the use of neither of the springs 61 and 64 and having a truly floating sleeve. The invention also contemplates the use of a single spring against which the motor will operate in alternating cycles.

In any event, in the operation of the apparatus in accordance with FIG. 3, the vanes 40 will engage the mud cake or the borehole wall and thus generate a force opposite to the direction of the vane slant. This in turn will enable the apparatus in accordance with FIG. 3 to move along the highly deviated boreholes.

Figure 4:
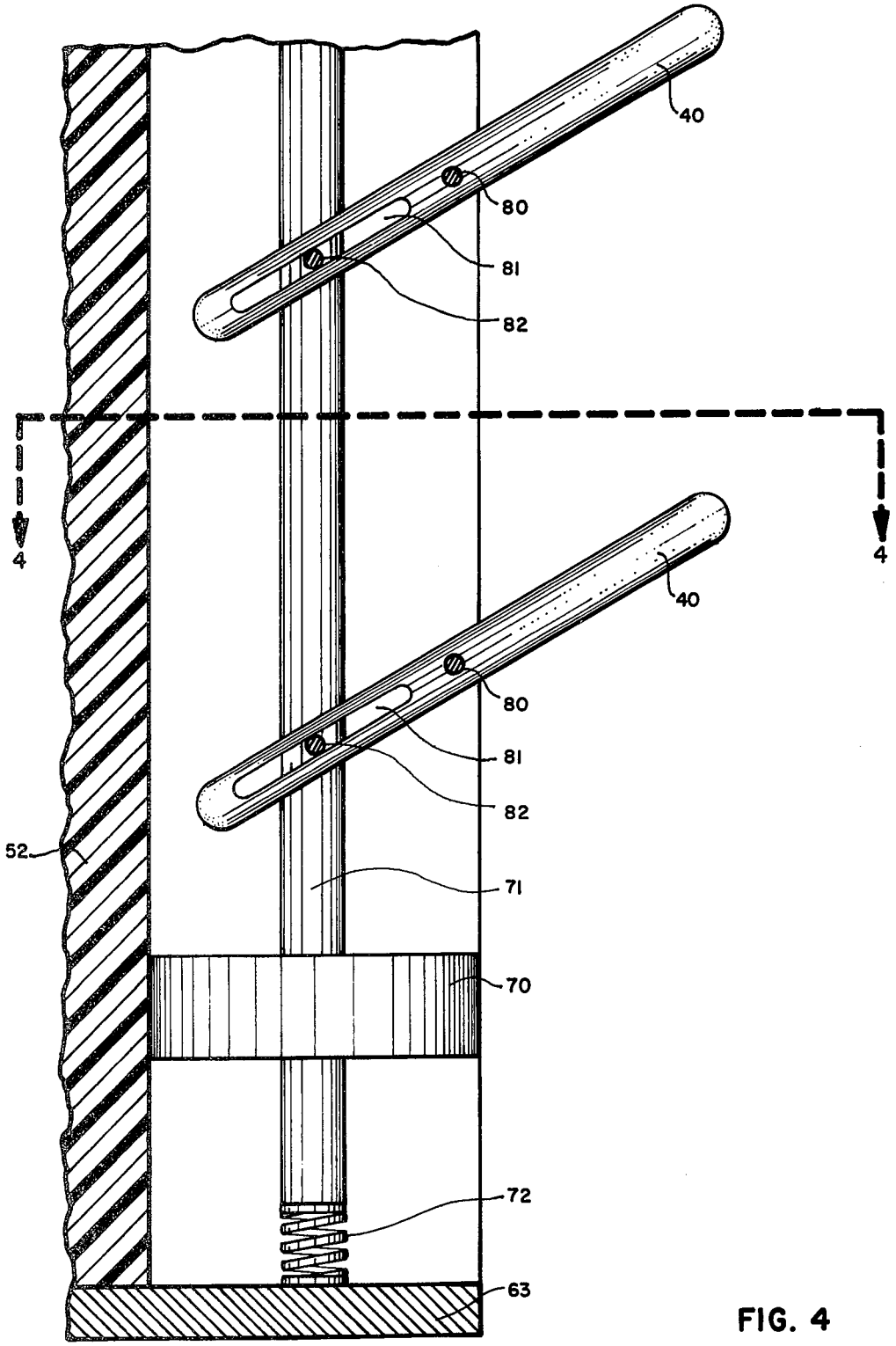
FIG. 4 is an enlarged schematic view, partly in cross section, showing the reversing mechanism for changing the direction of the slant of the vanes.

Referring now to FIG. 4, the reversing actuator is schematically illustrated and is shown as having a solenoid 70 through which a rod 71 is actuated by the solenoid. The lower end of the rod 71 is connected to a spring 72 which in turn is anchored to the end plate 63 illustrated in FIG. 3. It should be appreciated that the reversing mechanism is carried by the sleeve 53. Each of the vanes 40 is pivoted about pivot points 80 which are fixedly attached to the sliding sleeve 53. Each of the flexible vanes has an elongated slot 81 through which pivot pins 82 ride and which are fixedly attached to the solenoid rod 71.

In the operation of the apparatus in accordance with FIG. 4, whenever it is desired to have the instrument 30 travel downhole, the solenoid 70 is not actuated, and the spring 72 pulls the rod 71 down and thus causes the vanes 40 to be in the position illustrated.

Whenever it is desired to bring the instrument 30 out of the borehole, the solenoid 70 is actuated, preferably from the earth's surface, and the rod 71 moves up against the spring 72. This causes the vanes 40 to rotate around the pivot points 80 and while the pivot points 82 are sliding through the slots 81, the outer ends of the vanes will pivot down in the direction to facilitate removal of the apparatus 30 from the borehole.

Figure 5:
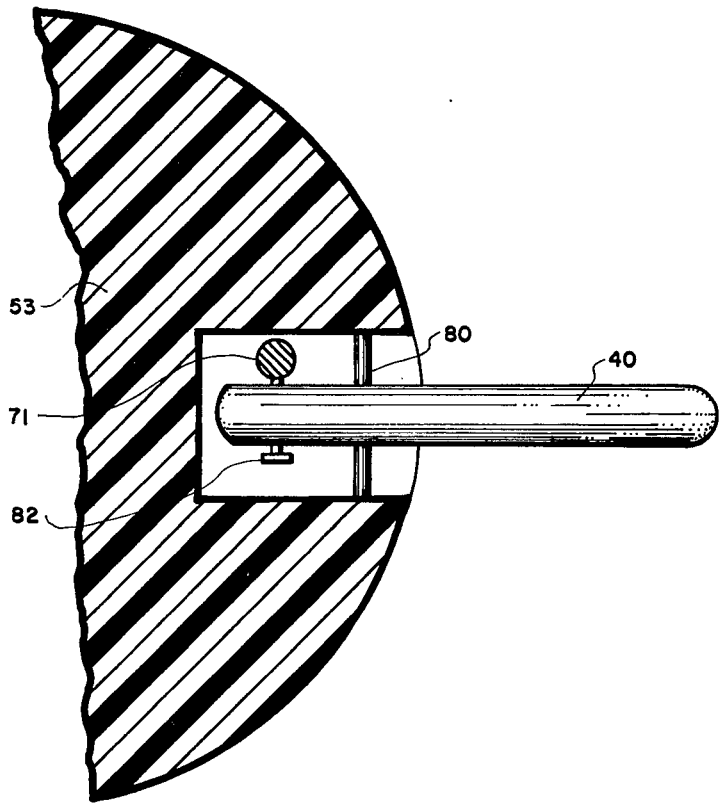
FIG. 5 is a top plan view, partly in cross section, taken along the lines 4—4 of FIG. 4.

Referring now to FIG. 5, there is illustrated a top plan view taken along the cross section lines 4—4 of FIG. 4. As shown in FIG. 5, the vane 40 is adapted to be rotated around the pivot pin 80 and is attached to the solenoid rod 71 by the pin 82 which slides within the slot 81 illustrated in FIG. 4.

Thus it should be appreciated that the preferred embodiments of the present invention have been described herein for an apparatus which easily moves through highly deviated boreholes by using flexible vanes on a sliding sleeve to impart additional force to the instrument. However, those skilled in the art will recognize that the preferred embodiments can be modified in obvious ways to utilize the present invention. For example, while the preferred embodiment contemplates the use of a mandrel having pulsed electromagnets therein surrounded by a sleeve having permanent ring magnets to control the vanes, those skilled in the art will recognize that the sleeve can be reciprocated back and forth around the mandrel by other well-known means, for example, by various hydraulic and electromechanical mechanisms. Furthermore, while the invention contemplates the use of a plurality of vanes, those skilled in the art will recognize that some additional useful force can be generated by the use of a single vane.

The embodiments of the invention in which an exclusive property or privilege is claimed are defined as follows:

1. Apparatus for traversing an inclined earth borehole, comprising:

an elongated instrument adapted to traverse an earth borehole, said instrument including a longitudinal support mandrel;

a plurality of electro-magnets spaced along the length of said mandrel;

a sliding sleeve encircling said mandrel and having a plurality of permanent magnets spaced along the length of said sleeve;

a plurality of flexible vanes attached to, and spaced along the length of, said sleeve, said vanes having a given angle with respect to said sleeve; and means to pulse said electro-magnets with electrical pulses to thereby cause said sleeve to reciprocate with respect to the mandrel and impart motion to the instrument in a direction away from the angled slant of the vanes.

2. The apparatus according to claim 1, including in addition thereto, means to vary the slant of the vanes while the instrument is in the borehole.

3. The apparatus according to claim 1, including in addition thereto, a well logging module in said instrument for determining characteristics of the formations surrounding the borehole.

4. Apparatus for traversing an inclined earth borehole, comprising:

an elongated instrument adapted to traverse an earth borehole, said instrument including a longitudinal support mandrel;

a sliding sleeve encircling said support mandrel;

at least one vane attached to said sleeve and having a given angle with respect to said sleeve; and means to reciprocate said sleeve with respect to said mandrel and thereby impart motion to the instrument in a direction away from the angled slant of said at least one vane.

5. The apparatus according to claim 4, including in addition thereto, means to vary the slant of said at least one vane while the instrument is in the borehole.

6. The apparatus according to claim 5, including in addition thereto, a well logging module in said instrument for determining characteristics of the formations surrounding the borehole.

7. The apparatus according to claim 4, including in addition thereto, spring means on at least one end of said sleeve for facilitating the floating of said sleeve about said mandrel.

* * * * *